US009768521B2

(12) United States Patent
Jang et al.

(10) Patent No.: US 9,768,521 B2
(45) Date of Patent: Sep. 19, 2017

(54) BUILT-IN ANTENNA DEVICE FOR ELECTRONIC COMMUNICATION DEVICE

(71) Applicant: Samsung Electronics Co., Ltd., Gyeonggi-do (KR)

(72) Inventors: Soo-Young Jang, Gyeongsangbuk-do (KR); Dong-Hwan Kim, Gyeonggi-do (KR); Austin Kim, Gyeonggi-do (KR); Se-Ho Kim, Gyeongsangbuk-do (KR); Kong-Min Sa, Gyeonggi-do (KR); Jae-Ho Lee, Gyeonggi-do (KR); Byung-Chan Jang, Gyeongsangbuk-do (KR); In-Jin Hwang, Gyeongsangbuk-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 614 days.

(21) Appl. No.: 13/768,499

(22) Filed: Feb. 15, 2013

(65) Prior Publication Data

US 2013/0249744 A1 Sep. 26, 2013

(30) Foreign Application Priority Data

Mar. 26, 2012 (KR) ..... 10-2012-0030432

(51) Int. Cl.

| | |
|---|---|
| ***H01Q 1/24*** | (2006.01) |
| ***H01Q 21/30*** | (2006.01) |
| ***H01Q 9/42*** | (2006.01) |

(52) U.S. Cl.

CPC ..... *H01Q 21/30* (2013.01); *H01Q 1/243* (2013.01); *H01Q 9/42* (2013.01)

(58) Field of Classification Search

CPC ..... H01Q 21/30; H01Q 9/42; H01Q 1/243; H01Q 5/307; H01Q 5/357; H01Q 5/364

USPC ..... 343/702, 725, 826

See application file for complete search history.

(56) References Cited

U.S. PATENT DOCUMENTS

| | | | | |
|---|---|---|---|---|
| 6,911,944 | B2 * | 6/2005 | Sekine | H01Q 1/243 343/700 MS |
| 7,084,831 | B2 * | 8/2006 | Takagi et al. | 343/860 |
| 7,180,464 | B2 * | 2/2007 | Chiang et al. | 343/833 |
| 7,180,750 | B2 * | 2/2007 | Shimizu | 361/787 |
| 8,618,990 | B2 * | 12/2013 | Somero | H01Q 9/42 343/702 |
| 2009/0295669 | A1 | 12/2009 | Su et al. | |

* cited by examiner

*Primary Examiner* — Dieu H Duong
(74) *Attorney, Agent, or Firm* — Cha & Reiter, LLC

(57) ABSTRACT

A built-in antenna device for an electronic device for communication used in a multi-band is provided. The built-in antenna device includes a PCB, a first antenna radiator disposed on the PCB, and a second antenna radiator which has the same power feeding point as the first antenna radiator and is disposed at a housing of the electronic device, wherein the first antenna radiator and the second antenna radiator are configured to operate at different frequency bands.

20 Claims, 5 Drawing Sheets

BUILT-IN ANTENNA DEVICE FOR ELECTRONIC COMMUNICATION DEVICE

CLAIM OF PRIORITY

This application claims the benefit under 35 U.S.C. §119(a) of a Korean patent application filed in the Korean Intellectual Property Office on Mar. 26, 2012 and assigned Serial No. 10-2012-0030432, the entire disclosure of which is hereby incorporated by reference.

BACKGROUND

1. Technical Field

The present disclosure relates to a built-in antenna device for an electronic communication device used in a multi-band communication system.

2. Description of the Related Art

Recently, rapid technical development in the Information Technology (IT) and wireless communication fields has resulted in the widespread manufacture and use of portable terminals. There have been a variety of electronic devices for communication, which provide several services to users through wireless data communication, in response to the rapid technical development. A portable terminal or mobile terminal is a general term used for any of a variety of handheld wireless communication devices, such as cell phones, smart phones, tablet PCs, notebook computers, global positioning system (GPS) devices, and personal digital assistants (PDAs). A portable terminal can be designed for use in two or more frequency bands, such as those of GSM850, GSM900, DCS 1800, PCS1900, and WCDMA band1. (GSM, DCS and PCS are acronyms for Global System for Mobile Communication, Digital Cellular System, and Personal Communication Service.)

Until recently, portable terminal antennas were external antennas, such as a helical, dipole or monopole antenna, with an omni-directional radiation characteristic. Given the problems of external antennas in terms of inconvenience and breakage, a trend has developed to equip portable terminals with built-in antennas within portable terminals. A built-in antenna typically has a flat panel structure, such as a micro strip patch antenna device or a Planar Inverted F Antenna (PIFA) device.

A typical structure of a built-in antenna includes a carrier which is formed with insulators such as polycarbonate, etc. installed in the portable terminal, and an antenna radiator of a circuit pattern shape capable of performing wireless transmission and reception in a specific frequency band mounted on this carrier.

A conventional method of manufacturing an antenna radiator used in a built-in antenna device may be one of an SUS fusion method of punching a desired pattern with a metal piece and fusing the pattern by heat on a body; an etching method of plating the whole molding body, leaving only a pattern, and removing the remainder; a double injection method of plating only a pattern on a molded body; a Laser Direct Structuring (LDS) method of engraving a conductor circuit on a 3 Dimensional (3D) surface of a component using laser and plating the component or a Printing Direct Structuring (PDS) method of directly printing a molded body with a conductive ink and plating the body.

The above-described antenna radiator used in the conventional built-in antenna device may differ slightly according to a manufacturing method of forming a pattern on a surface of a molding object and etching the surface. Because the antenna radiator is formed through a plurality of steps, production processes are complicated, productivity is reduced, and the cost of production is increased. In addition, because a dedicated space for installing the built-in antenna in the portable terminal is allocated, the size of the portable terminal is increased in order to accommodate built-in antenna.

To overcome the above-described problems, a wire type antenna formed by a polygon such as a circle, a quadrilateral, etc. may be built in. In general, there exist built-in antennas capable of simplifying production processes, improving productivity, and reducing the cost of production by forming a fixing protrusion on a case of a portable terminal, fixing a wire antenna radiator having a certain length and pattern, and electrically connecting the wire antenna radiator to a Printed Circuit Board (PCB) of the portable terminal. Also, built-in antennas capable of reducing a size of the portable terminal by reducing an installation space of the antenna radiator are in use.

Antenna mounting space is further minimized and a size of a portable terminal is reduced by designing the built-in antenna device to operate in two or more frequency bands (multi-band). Functions of the built-in antenna device have been on an expanding trend.

In general, a multi-band built-in antenna device may be a PIFA device in which there is one power feeding portion and one ground portion. This multi-band built-in antenna device was designed to cover key frequency bands of GSM850, GSM900, DCS 1800, PCS 1900, and WCDMA band1. The multi-band built-in antenna device has been widely used and may cover all of the low-frequency bands of GSM 850 to GSM900 through switching technologies in which a separate ground pad is added. Electronics for such switching adds complexity to the portable terminal.

Further, the multi-band built-in antenna device having this composition is installed or formed as one antenna radiator on a board or a carrier having a certain height installed on the board. A frequency band of GSM900 and frequency bands of DCS 1800, PCS 1900, WCDMA band1, etc. which are relatively high frequency bands generate mutual interference and cause radiation performance degradation of the multi-band built-in antenna device. Although radiation patterns of an antenna radiator having one frequency band and relatively high frequency bands are integrated with each other, they must be arranged spaced apart from each other at a certain distance. Therefore, a problem arises in that a mounting space of the multi-band built-in antenna device must be expanded.

SUMMARY

An aspect of the present invention is to solve at least the above-mentioned problems and/or disadvantages and to provide at least the advantages described below. Accordingly, an aspect of the present invention is to provide a built-in antenna device for an electronic communication device, which is designed to simplify manufacturing processes, enhance production efficiency, and save costs.

Another aspect of the present invention is to provide a built-in antenna device for an electronic communication device, having a relatively simple configuration but also durable, and with high reliability for long term use.

In accordance with an aspect of the present invention, a built-in antenna for an electronic communication device is provided. The antenna includes a PCB, a first antenna radiator disposed on the PCB, and a second antenna radiator which has the same power feeding point as the first antenna radiator and is disposed at a housing of the electronic device, wherein the first antenna radiator and the second antenna radiator are configured to operate in different frequency bands.

Advantageously, embodiments of the invention allow for a multi-band built-in antenna that is space-efficient, thereby facilitating a slim and compact design for a portable terminal, and with a configuration that facilitates the manufacturing process thereof.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION OF EXEMPLARY EMBODIMENTS

Exemplary embodiments of the present invention will be described herein below with reference to the accompanying drawings. In the following description, well-known functions or constructions are not described in detail to avoid obscuring the invention in unnecessary detail. Also, the terms used herein should be understood in the context of the description of the exemplary embodiments. Terms used may vary depending on user or operator intent and usage.

It is to be understood that the singular forms "a", "an" and "the" include plural referents unless the context clearly dictates otherwise. Thus, for example, reference to "a component surface" includes reference to one or more of such surfaces.

In describing an embodiment of the present invention, an electronic device including a built-in antenna may be any one of a variety of devices, such as a cell phone, a smart phone, a PDA, a Mobile Internet Device (MID), an Ultra Mobile Personal Computer (UMPC), a tablet PC, or a navigation device. Other electronic devices in a variety of fields, which are not carried and used primarily for communication, may be applied.

Figure 1:
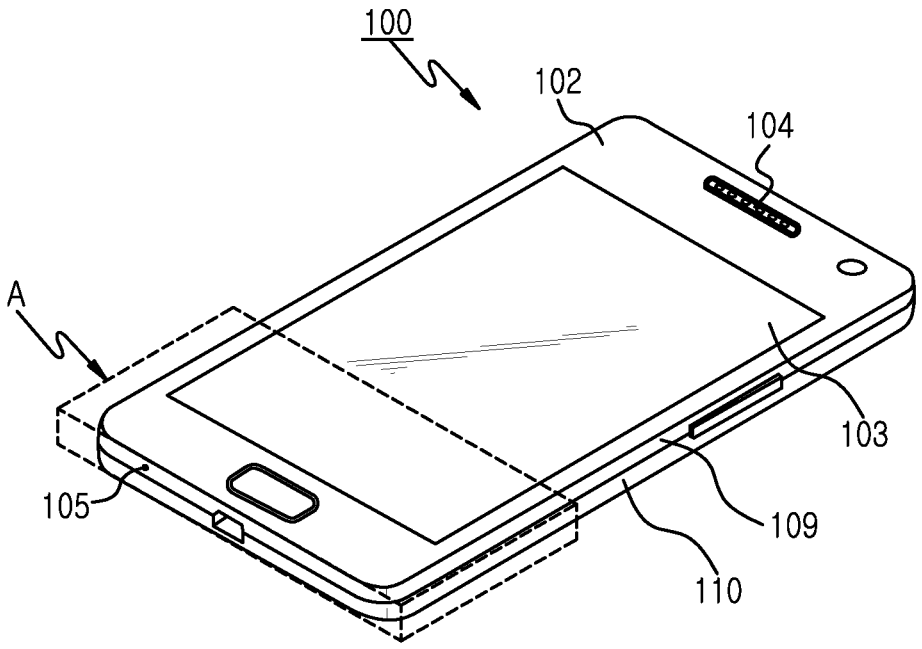
FIG. 1 is a perspective view of an electronic communication device, to which a multi-band built-in antenna device is applied according to an exemplary embodiment of the present invention.

FIG. 1 is a perspective view of a portable terminal, 100, which is one example of an electronic device including a multi-band built-in antenna device according to an embodiment of the present invention. Portable terminal 100 is configured with a lowercase frame (housing) 109 and an upper case frame (housing) 110 for supporting the constituent components and for ease of assembly. A display device 103 which is preferably a touch screen display, is disposed at a front surface 102 of the portable terminal 100. A speaker 104 for outputting sound of a called party is located above the display device 103. A microphone 105 for transmitting a voice to the called party is located at a lower side of the portable terminal 100. A camera module (not shown) and a variety of additional devices for implementing well-known other additional functions may be further installed in the portable terminal 100.

A built-in antenna device in accordance with the invention is disposed within the lower side labeled "A" of portable terminal 100. The antenna device is herein given the acronym WPH antenna, an abbreviation for Wire & PCB Embedded Pattern (PEP) Hybrid. The WPH antenna may alternatively be packaged within the upper region of the terminal 100.

Figure 2:
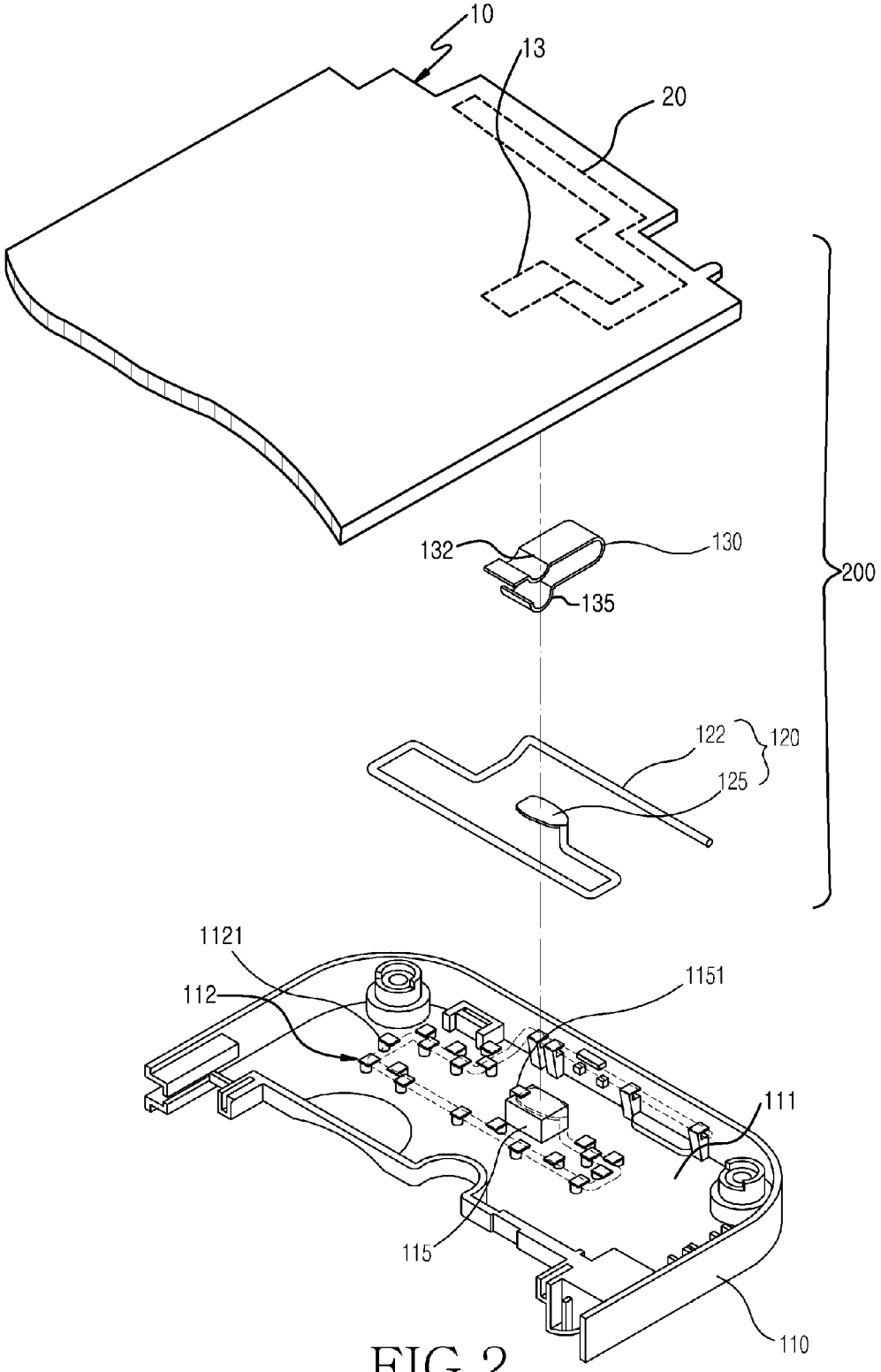
FIG. 2 is an exploded perspective view of the built-in antenna device of FIG. 1 according to an embodiment of the present invention.

FIG. 2 is an exploded perspective view of an exemplary WPH antenna, a built-in antenna device, 200, which may be packaged within the portable terminal 100 of FIG. 1, according to an embodiment of the present invention. WPH antenna 200 is composed of first and second antenna radiators 20 and 120. The second antenna radiator 120 is a wire type radiator in the illustrated embodiment, is disposed on the case frame 110. Other types of radiators are possible for radiator 120, and discussed later; however, the following description will assume radiator 120 is in the form of a wire. The first antenna radiator 20 is embodied as a PEP antenna radiator 20 which is formed as a metal pattern on a printed circuit board (PCB)10. (First radiator 20 is depicted in shadow in FIG. 2 as it is patterned on the bottom side of PCB 10.) Second radiator 120 is preferably attached to the case frame 110. Second radiator 120 and the PEP antenna radiator 20 have a common power feeding point, and are configured to operate in different frequency bands. When the case frame 110 and the PCB 10 are assembled and portable terminal 100 is powered up, the second radiator 120 transmits and receives RF power from and to RF communication components of portable terminal 100.

The two antenna radiators 120 and 20 preferably operate in different frequency bands. Second radiator 120 which is attached to the case frame 110 is designed (e.g. optimized) to operate in a frequency band which is lower than that of the PEP antenna radiator 20. For example, the second radiator 120 may be configured to operate in a frequency band of GSM900 (880 MHz~960 MHz). The PEP antenna radiator 20 disposed in the PCB 10 may be configured to operate in at least one frequency band of DCS1800 (1710 MHz~1880 MHz), PCS1900 (1850 MHz~1990 MHz), and WCDMA band1(1920 MHz~2170 MHz). Thus, in this example, the highest and lowest operating frequencies of wire radiator 120 PEP radiator 20 are 960 MHz and 1710 MHz, respectively. In this case, the higher frequency radiator is configured to operate at a frequency that is at least 1.78× higher than an operating frequency of the lower frequency radiator The built-in antenna device 200 can prevent a degradation phenomenon associated with conventional multi-band antennas, which is caused by mutual interference. Such degradation is avoided by not arranging antenna radiators designed for different frequency bands on the same plane and separating the antenna radiators. Antenna device 200, by virtue of its compact configuration, also contributes to slimness of the portable terminal, efficiently using an installation space within the portable terminal by arranging second radiator 120 proximate or attached to the housing.

The second radiator 120 is formed in a predetermined pattern and fixed to an internal surface 111 of the housing 110. The second radiator 120 has a configuration in which it is electrically connected with a power feeding portion 13 of a PCB 10 by a suitable electric connection means. In the illustrated embodiment, the electric connection means is a metallic C-clip 130.

The second radiator 120 radiates a transmission signal to the exterior using current fed from the PCB 10, routes a reception signal received from the outside to the PCB 10.

The housing 110 includes suitable attachment means to hold the second radiator in a fixed, steady position. In the illustrated embodiment, the attachment means includes guide portions 112 capable of fixing the second radiator 120 to the inner surface 111, and a supporting portion 115, which protrudes from the housing 110 in the area of a power feed point of the PCB 10. An upper part of supporting portion 115 is flat, in a position corresponding to the power feeding portion 13 of the PCB 10. In an alternative design, the supporting portion 115 can be omitted, e.g., if a structure of the wire type antenna radiator 120 itself is self-supporting.

Each guide portion 112 can include a cylindrical post, as shown, and fixed protrusions 1121 atop the post. The guide portions 112 can be formed at regular intervals along the internal surface 111 of the housing 110. The second radiator 120 is composed of a terminal portion 125 and a wire portion 122, of a predetermined bent shape. The bent shape can be pre-formed, or it can be formed as the radiator is installed within the guide portions 112, if the radiator 120 is formed of a flexible metal and capable of being bent to fit within the guide portions 112. In either case, wire portion 122 passes along the fixed protrusions 1121 and is secured thereby when installed. Accordingly, by designing wire portion in a bent shape, a long electrical length for the radiator 120, i.e., long enough to achieve operation at a desired frequency, can be packaged within a relatively small space. Also, after the wire portion 122 is secured within the guide portions 112, a more secure attachment can be made by heat fusing the fixing protrusions 1121 to an external surface of the wire portion 122.

The guide portions 112 may be formed by a variety of methods to produce fixing grooves corresponding to the shape of the wire portion 122 such that all or part of the wire portion 122 can be buried and secured in the grooves. Also, only the wire portion 122 of the wire type antenna radiator 120 may be inserted into a case frame of plastic material using insert molding, and only a terminal portion may be exposed.

An upper portion of the supporting portion 115 protruded and formed from the internal surface 111 of the case frame 110 in a power feeding portion direction of the PCB 10 is equipped with a flat surface. A protrusion 1151 for fixing the terminal portion 125 may be formed at one side of the supporting portion 115.

The wire type antenna radiator 120 includes the wire portion 122 which is supported by the guide portions 112 and is bent along the guide portions 112, and the terminal portion 125 of a plane shape which is integrated with the wire portion 122 at one end thereof and is positioned on the supporting portion 115. The terminal portion 125 preferably has a flat surface to easily come in contact with an electric connection means 130 through processes of rolling, etc.

In general, the wire type antenna radiator 120 is formed by conductive material such as copper (Cu) and has a cross section of a circle or a quadrilateral. The flat terminal portion 125 can be formed by rolling the end of the wire portion 122 to thereby flatten it out. Electroless plating of the wire portion 122 and the terminal portion 125 may be performed with a conductive material such as copper and/or nickel. This wire type radiator 120 is advantageous in that an antenna device itself is easily changed according to its intended use, in contrast with conventional built-in antennas that are completely pre-patterned on a PCB. Also, the terminal portion 125 of the wire type antenna radiator 120 is positioned on the supporting portion 115 of the case frame 110. The terminal portion 125 may be strongly fixed on the supporting portion 115 by fusing the protrusion 1151 by heat.

Figure 5:
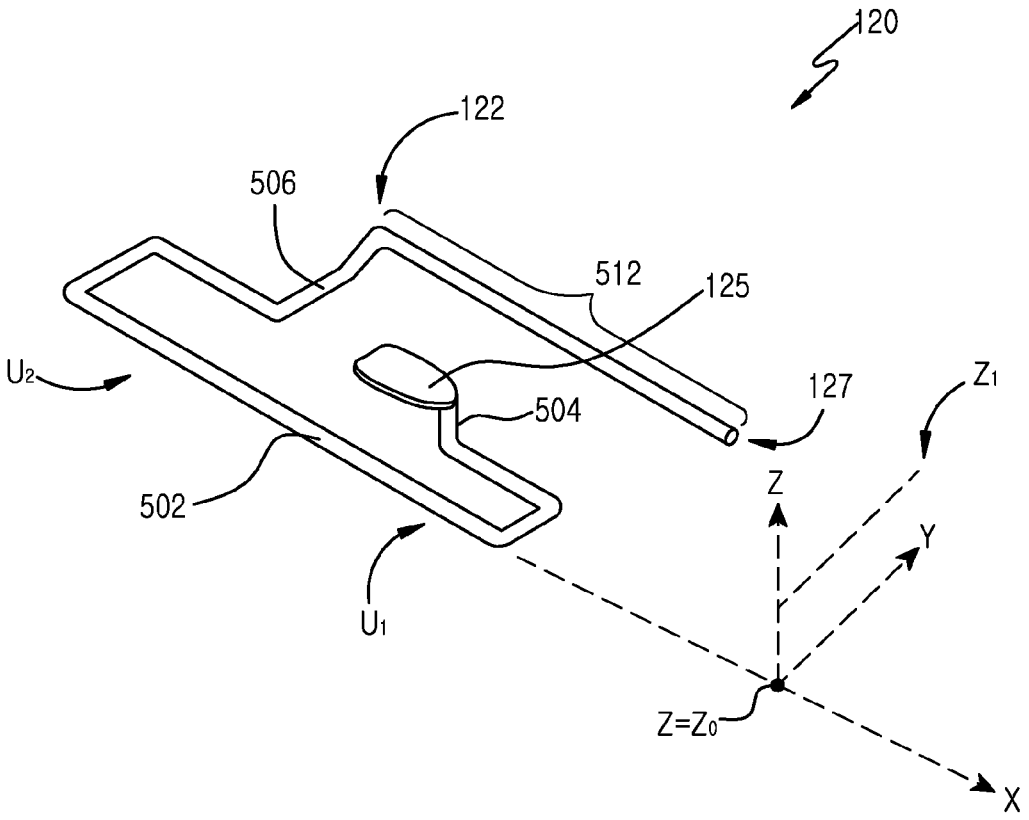
FIG. 5 is a perspective view of an embodiment of a wire radiator in the built-in antenna device of FIG. 2.

Referring momentarily to FIG. 5, an exemplary shape for the second radiator 120 is illustrated in a perspective view, which is the same as that shown in FIG. 2. An X-Y plane (where $Z=Z_0$) is assumed to coincide with the lower surface 111 of the housing 110, to which the lowest surfaces of radiator 120 are fixed. On one end of the radiator 120 is the terminal portion 125 located at a height $Z_1$ above the lower XY plane at $Z_0$. A wire portion 504, oriented in the Z direction, extends from the terminal portion 125 to the lower level $Z_0$. Wire portion 504 connects to a first U shaped portion U1 at the lower level $Z_0$, which connects to a second U shaped portion U2 at the opposite end. The connection is made through a linear wire portion 502 oriented in the X direction, which is unitary with one side of each U portion U1, U2, all situated at the lower level $Z_0$. A transition portion 506 oriented in the Y direction transitions from U2 back to a higher Z level such as $Z_1$, where another X oriented portion 512 connects and extends to an opposite end 127 of the radiator 120. The total length of the radiator from terminal portion 125 to the opposite end 127 is selected to achieve a desired antenna performance over a particular operating frequency band or The lengths of portions 502, 506 and 512 and the dimensions of the U portions U1, U2 are also factors that impact antenna performance Returning to FIG. 2, the C-clip 130 used as the electric connection means is bent at its center by a curved shape and has elasticity to realize a spring loaded electrical connection on opposite sides. A connection portion 132 positioned at one end of the C-clip 130 may come in contact with the power feeding portion 13 for electrical connection therewith, and an elastic portion 135 positioned at the other end may be in a state where it comes in contact with the terminal portion 125 of the wire type antenna radiator 120. Accordingly, C-clip 130 is interposed between the terminal portion 125 and a terminal portion 15 (see FIG. 3) of the PCB 10 and promotes smooth electric connection.

As an alternative to the C-clip 130, other electric connection means may be used, e.g., one of a variety of conductive materials such as a well-known conductive tape of a certain thickness.

As described above, the wire type antenna radiator 120 is used according to an embodiment of the present invention. However, a variety of conductors which are not applied to the PCB 10 and may be applied to the inside of an electronic device may be used in the alternative. For example, a metal plate type antenna radiator having a radiation pattern of a certain shape may be fixed to an inner side of a case frame of an electronic device by a bonding type, a heat fusion type, etc. Also, a Flexible Printed Circuit (FPC) having a pattern of a certain shape may be attached to an inner side of a case frame. Also, as described above, a metal body which is not a wire, having a pattern of a certain shape, may be inserted into the case frame of plastic material by insert molding. If the antenna radiator 120 is independent, any of the above described embodiments thereof may not be disposed directly at an inner side of a case frame of an electronic device. That is, the metal body may be disposed in a space between the PCB 10 and an inner side of a case frame.

Figure 3:
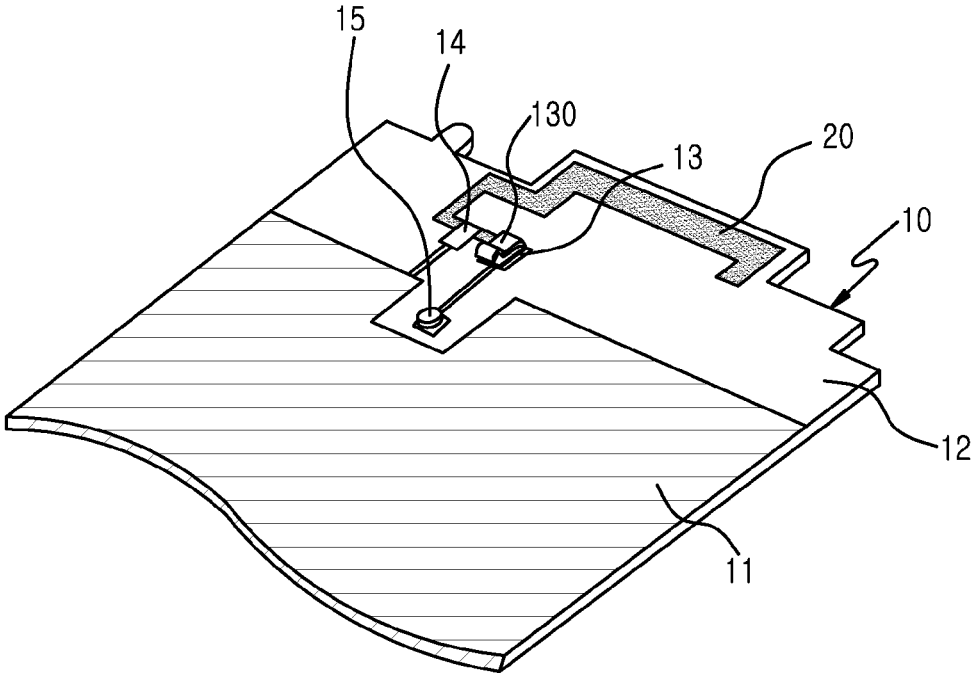
FIG. 3 is a perspective view illustrating a PCB Embedded Pattern (PEP) antenna radiator disposed on a PCB of the built-in antenna device of FIG. 1 according to an embodiment of the present invention.

FIG. 3 illustrates an example antenna radiator 20 disposed on a PCB in a built-in antenna device of FIG. 2 according to an embodiment of the present invention.

Referring to FIGS. 2 and 3, the bottom surface of the PCB 10, in the view of FIG. 2, is shown as the top surface in FIG. 3. On this surface, PCB 10 is divided into a ground region 11 and a non-ground region 12. The PEP antenna radiator 20 according to an embodiment of the present invention is disposed on the non-ground region 12. Also, the power feeding portion 13 and a grounding portion 14 are formed as pads on the non-ground region 12. The power feeding portion 13 is electrically connected with the PEP antenna radiator 20 at an end thereof. A short electrical distance away, the radiator 20 is shunted to ground 11 via grounding portion 14, to create a shunt capacitance as in a conventional PIFA antenna for matching at a desired frequency band. The above-described power feeding portion 13 is electrically connected with a terminal portion 15 (e.g., a Radio Frequency (RF) end of portable terminal 100) and performs a power feeding operation. The ground portion 14 is electrically connected with the ground region 11 of the PCB 10. It is suitable for the above-described PEP antenna radiator 20 to be formed as a monopole type or a Planar Inverted F Antenna (PIFA) type antenna.

Also, the PEP antenna radiator 20 may be configured to operate in a frequency band which is relatively higher than an operating frequency band of the above-described second antenna radiator 120. To this end, the physical length of antenna radiator 20 can be shorter than that of antenna radiator 120 (to achieve operation as the same type of antenna, e.g., a $\lambda/4$ monopole or PIFA antenna).

The C-clip 130 may be attached by bonding to the power feeding portion 13 of the PCB 10. Accordingly, when the PCB 10 is assembled with the case frame 110, the power feeding portion 13 of the PCB 10 may perform a power feeding operation by coming in contact with the terminal portion 125 of the wire type antenna radiator 120.

Figure 4:
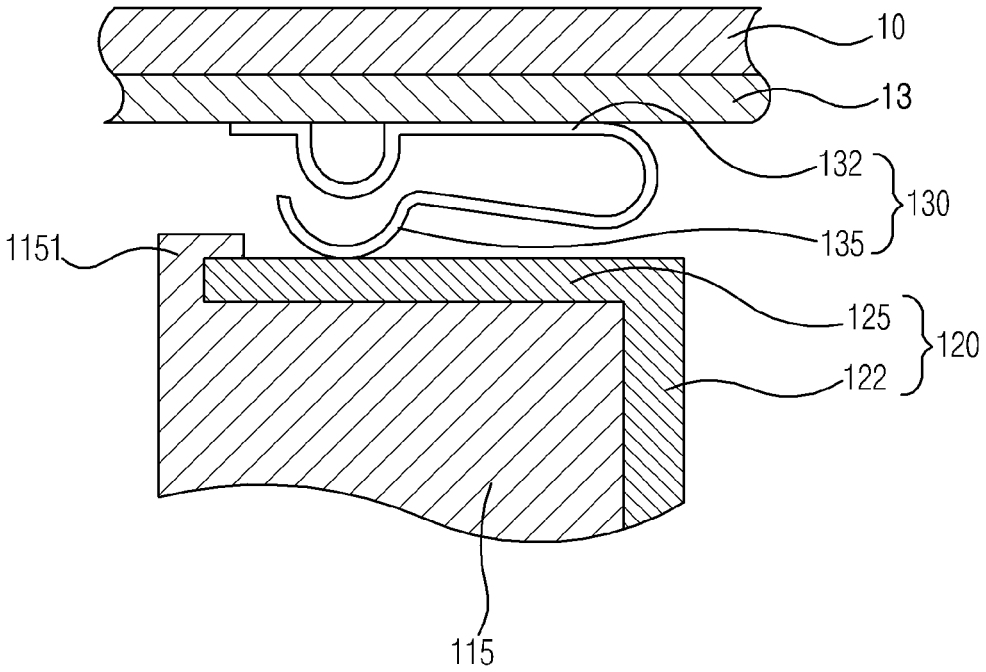
FIG. 4 is a cross-section view illustrating a state where a wire type antenna radiator of the built-in antenna device of FIG. 1 is electrically connected with a power feeding portion of a PCB according to an embodiment of the present invention.

FIG. 4 is cross-sectional view illustrating a state where a wire type antenna radiator in the built-in antenna device of FIG. 1 is electrically connected with a power feeding portion of a PCB according to an embodiment of the present invention.

Referring to FIGS. 2 and 4, the PCB 10 and the case frame 110 are arranged and assembled in a state where the flat connection portion 132 of the C-clip 130 is fixed to a terminal portion 15 of the PCB 10. The elastic portion 135 of the C-clip 130 holds contact by elastic power while coming in contact with the terminal portion 125 disposed and fixed on the supporting portion 115 formed at an internal surface of the case frame 110.

In this case, the wire type antenna radiator 120 disposed at an internal side of the case frame 110 and the PEP antenna radiator 20 disposed on the PCB 10 have the same power feeding point and operate as the single antenna device 200. However, the wire type antenna radiator 120 operates in a low-frequency band, and the PEP antenna radiator 20 operates in a high-frequency band to achieve desired dual band operation while preventing mutual interference between different bands.

Tables 1 to 3 are tables listing experimental results comparing a WPH antenna in accordance with the invention with a conventional dual band antenna formed as two antennas on a PCB operated with a switching scheme. Table 1 provides results for 3D Total Isotropic Sensitivity/Total Radiated Power (TIS/TRP) performance. Table 2 shows results for Specific Absorption Rate (SAR) (10 g) performance. Table 3 shows results for Radiated Spurious Emission (RSE) performance. As evident in the shown results, the WPH antenna performance is comparable to that of the conventional antenna. Advantageously, these results are achieved by packaging the WPH antenna in a smaller space of the portable terminal than the conventional antenna, and without a complicated switching scheme as used in the prior art. (It should be noted, in the tables, "Free" denotes a condition in which the portable terminal is not held by the user; denotes a condition in which the portable terminal is held only in the user's hand but not by the head, as in a texting operation; and "Head+Hand" denotes a condition in which the terminal is held next to the user's ear during a call.)

TABLE 1

3D TIS/TRP

| | | Avg. [dBm] | | | | | | | |
|---|---|---|---|---|---|---|---|---|---|
| | | GSM900 | | DCS | | WCDMA1 | | WCDMA8 | |
| | | TIS | TRP | TIS | TRP | TIS | TRP | TIS | TRP |
| Free | Conventional Ant. | −105.5 | 28.7 | −104.8 | 27.3 | −106.7 | 19.3 | −104.7 | 19.1 |
| | WPH Ant. | −106.6 | 28.9 | −105.1 | 27.1 | −106.6 | 19.1 | −104.6 | 19.7 |
| | Δ | ↑1.1 | ↑0.2 | ↑0.3 | ↓0.2 | ↓0.1 | ↓0.2 | ↓0.1 | ↑0.6 |
| Hand | Conventional Ant. | −100.0 | 22.4 | −102.1 | 23.5 | −103.3 | 14.5 | −100.0 | 11.8 |
| | WPH Ant. | 101.2 | 22.5 | 102.3 | 23.5 | 102.9 | 14.6 | 101.4 | 12.9 |
| | Δ | ↑1.2 | ↑0.1 | ↑0.2 | — | ↓0.4 | ↑0.1 | ↑1.4 | ↑1.1 |
| Head & Hand | Conventional Ant. | −95.6 | 20.1 | −100.7 | 20.3 | −102.2 | 12.8 | −95.8 | 10.2 |
| | WPH Ant. | −96.0 | 20.1 | −101.1 | 20.5 | −101.6 | 13.2 | −95.7 | 11.3 |
| | Δ | ↑0.4 | — | ↑0.4 | ↑0.2 | ↓0.6 | ↑0.4 | ↓0.1 | ↑1.1 |

TABLE 2

−10 g SAR

| W/kg | GSM900 | DCS | WCDMA1 | WCDMA8 |
|---|---|---|---|---|
| Conventional Ant. | 1.00 | 0.66 | 0.71 | 0.00 |
| WPH Ant. | 0.90 | 0.67 | 0.70 | 0.69 |
| Δ | ↓0.1 | ↑0.01 | ↓0.01 | ↑0.03 |

TABLE 3

| RSE | | | | | | | | | |
|---|---|---|---|---|---|---|---|---|---|
| | dBm | | | | | | | | |
| | GSM900 | | | DCS | WCDMA1 | | WCDMA8 | | |
| | 2F | 3F | 4F | 2F | 2F | 3F | 2F | 3F | 4F |
| Conventional Ant. | −37.7 | −47.6 | −45.9 | −32.5 | −45.7 | −55.4 | −63.1 | −67.5 | −58.3 |

TABLE 3-continued

| RSE | | | | | | | | | |
|---|---|---|---|---|---|---|---|---|---|
| | dBm | | | | | | | | |
| | GSM900 | | | DCS | WCDMA1 | | WCDMA8 | | |
| | 2F | 3F | 4F | 2F | 2F | 3F | 2F | 3F | 4F |
| WPH Ant. | −37.8 | −52.4 | −48.8 | −39.4 | −44.7 | −51.8 | −51.8 | −67.2 | −57.0 |
| Δ | ↑0.1 | ↑4.8 | ↑2.9 | ↑6.9 | ↓1.0 | ↓3.6 | ↓11.3 | ↓0.3 | ↓1.3 |

It is noted that a SAR which satisfies 2.0 W/Kg or less is a standard value of a Global System for Mobile communications (GSM) terminal.

Tables 4 to 7 are tables showing field test results of the built-in antenna device (WPH) according to an embodiment of the present invention as compared to results of the conventional antenna device.

TABLE 4

| Field Test | | | | | |
|---|---|---|---|---|---|
| Classification | Outgoing/Incoming | Result | WPH Ant. - Conventional Ant. (E3213K) | WPH Ant. | Conventional Ant. (E3213K) |
| GSM Voice Call | Outgoing Call | equal | ▼5.0% | 82.5% | 87.5% |
| | Incoming Call | inferiority | ▼7.5% | 57.5% | 65.0% |
| | probability of success | equal | 0.0% | 100.0% | 100.0% |
| DCS VT (Video Telephony-Call) | Outgoing Call | Superiority | ▲22.5% | 85.0% | 62.5% |
| | Incoming Call | Superiority | ▲7.5% | 67.5% | 25.0% |
| | probability of success | equal | 0.0% | 100.0% | 100.0% |

TABLE 5

| Field Test | | | | | |
|---|---|---|---|---|---|
| Classification | Mute/Call Drop | Result | WPH Ant. − Conventional Ant. (E3213K) | WPH Ant. | Conventional Ant. (E3213K) |
| GSM Voice Call | Mute (Tx) | inferiority | ▼8.8% | 8.8% | 0.0% |
| | Mute (Rx) | equal | ▼5.0% | 21.3% | 16.3% |
| | Call Drop | equal | 0 | 0 | 0 |
| DCS Voice Call | Mute (Tx) | Superiority | ▲18.8% | 21.3% | 40.0% |
| | Mute (Rx) | equal | ▲2.5% | 13.8% | 16.3% |
| | Call Drop | equal | 0 | 0 | 2 |

TABLE 6

| Field Test | | | | | |
|---|---|---|---|---|---|
| Classification | Outgoing/Incoming | Result | WPH Ant. − Conventional Ant. (E3213K) | WPH Ant. | Conventional Ant. (E3213K) |
| WCDMA1 Voice Call | Outgoing Call | equal | ▼2.5% | 72.5% | 75.0% |
| | Incoming Call | equal | 0.0% | 72.5% | 72.5% |
| | probability of success | equal | 0.0% | 100.0% | 100.0% |
| W1 VT (Video Telephony-Call) | Outgoing | equal | ▲2.5% | 92.5% | 90.0% |
| | Incoming | Superiority | ▲7.5% | 80.0% | 75.0% |
| | probability of success | equal | 0.0% | 100.0% | 100.0% |

TABLE 7

| Field Test | | | | | |
|---|---|---|---|---|---|
| Class-ification | Mute/Call Drop | Result | WPH Ant. – Conven-tional Ant. (E3213K) | WPH Ant | Conven-tional Ant. (E3213K) |
| WCDMA1 | Mute (Tx) | equal | ▲5.0% | 42.5% | 47.5% |
| Voice Call | Mute (Rx) | equal | ▲5.0% | 7.5% | 12.5% |
| | Call Drop | equal | 0 | 3 | 3 |
| W1 | Mute (Tx) | Superiority | ▲15.0% | 10.0% | 25.0% |
| VT-Call | Mute (Rx) | Superiority | ▲8.8% | 16.3% | 25.0% |
| | Call Drop | equal | 0 | 0 | 0 |

As seen in Tables 4 to 7, it is apparent that comparable field results are obtained between the WPH antenna and the conventional antenna. For example, it is apparent that the built-in WPH antenna device is superior to the conventional antenna device in a DCS band which is a high frequency band. Because the WPH antenna device operates in the DCS band by the PEP antenna radiator of the PCB, the DCS band may exhibit performance which is superior to the conventional multi-band built-in antenna device.

The PEP antenna radiator according to an embodiment of the present invention is formed on the PCB by a pattern type and feeds power to the RF end. Because the wire type antenna radiator and the PEP antenna radiator are spaced apart and installed in opposing orientations from one other, mutual interference between the PED antenna radiator and the wire type antenna radiator which operate in different frequency bands is removed.

Preferably, the wire type antenna radiator may have cross sections of a variety of shapes. The wire type antenna radiator 120 is fixed to an internal surface of the housing of the electronic device. When the PCB 10 is assembled to the housing, the power feeding terminal of the wire type antenna radiator is constructed to be electrically connected with the power feeding portion of the PEP antenna radiator.

More preferably, the wire type antenna radiator is designed (e.g., optimized) to operate in a frequency band which is relatively lower than that of the PEP antenna radiator. Mutual interference between the PEP antenna radiator and the wire type antenna radiator which operate in different frequency bands may be efficiently avoided.

Because the antenna radiators which operate in different frequency bands are disposed not the same plane but rather, one is disposed at the case frame and the other is disposed printed on the PCB, and, feed power is supplied to the same power feeding point, the built-in antenna device according to embodiments of the present invention may prevent an antenna mounting space from being expanded by necessity to achieve specified performance criteria due to mutual interference, and may therefore contribute to achieving slimness of an electronic device.

Also, because an inexpensive wire antenna radiator is applied, the built-in antenna device according to one embodiment of the present invention may save manufacturing costs and improve assemblage.

In addition, because a wire type antenna radiator is disposed at a case frame and is electrically connected with a PCB by only a process of assembling the case frame and the PCB, the built-in antenna device according to one embodiment of the present invention may improve assemblage.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A built-in antenna device disposed within a housing of an electronic communication device, the built-in antenna device comprising:

a printed circuit board ("PCB");

a first antenna radiator formed as a metal pattern on a surface of the PCB and spaced from an inner surface of the housing; and a second antenna radiator which is fed from the same power feeding point as the first antenna radiator and having a first portion extending from a power feeding terminal thereof towards the inner surface of the housing and being bent in a transition to a second portion that is attached to and runs along the inner surface, the second antenna radiator being in a form of a wire radiator, a metal plate of a defined pattern, or a Flexible Printed Circuit (FPC) including a metal pattern;

wherein the first antenna radiator and the second antenna radiator are configured with different lengths so as to operate in different frequency ranges such that the antenna device is operable as a dual band antenna, and the first and second antenna radiators are installed opposing one another within the housing.

2. The built-in antenna device of claim 1, wherein:

the second antenna radiator is substantially in the form of the wire radiator, the wire radiator having a wire portion with a circular or quadrangular cross section, and a flat terminal portion supported by a protrusion from the inner surface of the housing; and the antenna device further including an electrical connector having a first side bonded to the metal pattern on the surface of the PCB and an opposite side which makes a spring loaded connection to the flat terminal portion of the wire radiator.

3. The built-in antenna device of claim 1, wherein the first antenna radiator is configured for optimized operation in a frequency range approximately twice as high as a frequency range for which operation of the second antenna radiator is optimized.

4. The built-in antenna device of claim 1, wherein the second antenna radiator is a metal body having an insert-molded pattern within the housing.

5. The built-in antenna device of claim 1, wherein, the first antenna radiator and the second antenna radiator are configured to be electrically connectable in a manner such that, when the PCB is assembled to the housing, the power feeding terminal of the second antenna radiator becomes electrically connected with a power feeding portion of the first antenna radiator.

6. The built-in antenna device of claim 5, further comprising an electrical connection means for connecting the first antenna radiator with the second antenna radiator.

7. The built-in antenna device of claim 6, wherein the electrical connection means is one of a C-clip and a conductive tape which have elasticity and are attached to a power feeding portion of the first antenna radiator and wherein the electrical connection means has elasticity and comes in contact with the power feeding terminal of the second antenna radiator when the PCB and a case frame are assembled.

8. The built-in antenna device of claim 1, wherein the first antenna radiator is configured to operate in a frequency band which is approximately twice as high as that of the second antenna radiator.

9. The built-in antenna device of claim 8, wherein the first antenna radiator is implemented to operate in at least one frequency band of DCS 1800, PCS1900, WCDMA series, and LTE series and wherein the second antenna radiator is implemented to operate in at least one frequency band of GSM850 and GSM900.

10. The built-in antenna device of claim 1, wherein the second antenna radiator is in the form of the wire radiator, and includes:

a wire portion of a defined shape and length, the wire portion including the second portion which is fixed to the an inner surface of the housing at a first z-axis level, and a third portion which is fixed to a sidewall surface of the housing at a second z-axis level, the z-axis being in a thickness direction of the electronic communication device; and the first portion including a terminal portion which is integrated with the wire portion at one end of the wire portion and is electrically coupled to the PCB.

11. The built-in antenna device of claim 10, wherein the terminal portion is formed by forming one end portion of the wire portion as a plane by rolling and performing electroless plating with at least one conductive material.

12. The built-in antenna of claim 10, further comprising a plurality of fixing protrusions, which are protruded and formed at regular intervals, at an internal side of the housing, wherein the wire portion is supported to the protrusions, is fused by heat, and is closely fixed to the inner surface of the housing.

13. The built-in antenna of claim 12, wherein the terminal portion is formed by forming one end portion of the wire portion as a plane by performing electroless plating.

14. A built-in antenna device disposed within a housing of an electronic communication device, the built-in antenna device comprising:

a printed circuit board (PCB);

a first antenna radiator formed as a metal pattern on a surface of the PCB and spaced from an inner surface of the housing, and extending from a power feeding portion to a first free end; and a second antenna radiator which is fed from the same power feeding point as the first antenna radiator and having a first portion extending from a power feeding terminal towards the inner surface of the housing and being bent in a transition to a second portion that is attached to and runs along the inner surface, the second antenna radiator being in a form of a wire radiator, a metal plate of a defined pattern, or a Flexible Printed Circuit (FPC) including a metal pattern;

wherein the first antenna radiator and the second antenna radiator are configured with different lengths so as to operate in different frequency ranges such that the antenna device is operable as a dual band antenna, and the first and second antenna radiators are installed opposing one another within the housing, in which the second portion of the second antenna radiator transitions via a U-shaped transition to a third portion that extends to a second free end located on an opposite side of the electronic communication device as the first free end.

15. An electronic communication device comprising:

a housing;

a built-in antenna device comprising:

a printed circuit board ("PCB");

a first antenna radiator formed as a metal pattern on a surface of the PCB, lying substantially in a first x-y plane, and extending from an input end to a first free end located on a first side of the electronic communication device; and a second antenna radiator which is fed from the same power feeding point as the first antenna radiator and having a first portion beginning at a power feeding terminal proximate the first x-y plane, the first portion extending towards an inner surface of the housing and being bent in a transition to a second portion that runs parallel to the inner surface in substantially a second x-y plane spaced from the first x-y plane in a z-axis direction, the second antenna radiator being in a form of a wire radiator, a metal plate of a defined pattern, or a Flexible Printed Circuit (FPC) including a metal pattern, wherein the first antenna radiator and the second antenna radiator are configured with different lengths to operate in different frequency ranges such that the antenna device is operable as a dual band antenna, and the first and second antenna radiators are installed opposing one another within the housing, in which the second portion of the second antenna radiator transitions via a U-shaped transition to a third portion that extends to a second free end located on a second side of the electronic communication device opposite the first side.

16. The electronic device of claim 15, wherein the second portion of the second antenna radiator includes a further U-shaped section connected to the first portion.

17. The electronic device of claim 16, wherein, the first antenna radiator and the second antenna radiator are configured to be electrically connectable in a manner such that, when the PCB is assembled to the housing of the electronic device and the power feeding terminal of the second antenna radiator become electrically connected with a power feeding portion of the first antenna radiator.

18. The electronic device of claim 15, wherein the second antenna radiator is in the form of the wire radiator, which includes a wire having a circular or quadrangular cross section.

19. The electronic device of claim 15, wherein the first antenna radiator is configured for optimized operation in a frequency range approximately twice as high as a frequency range for which operation of the second antenna radiator is optimized.

20. The electronic device of claim 15, wherein the second antenna radiator is a metal body which has an insert-molded radiation pattern on a case frame of the electronic device.

* * * * *